United States Patent [19]

Tubbs et al.

[11] 4,002,184

[45] Jan. 11, 1977

[54] WATER FLOW ACTUATED AIR CHARGING DEVICE

[76] Inventors: Howard A. Tubbs, 406 S. Elizabeth St., Whitewater, Wis. 53190; Donald M. Waltz, 1501 Roosevelt Drive, Atlantic, Iowa 50022

[22] Filed: Sept. 2, 1975

[21] Appl. No.: 609,287

[52] U.S. Cl. ..... 137/211; 417/38

[51] Int. Cl.[2] ..... F04F 1/00

[58] Field of Search ..... 137/211, 211.5; 417/38

[56] References Cited

UNITED STATES PATENTS

| | | | |
|---|---|---|---|
| 2,447,173 | 8/1948 | Gordon | 137/211.5 X |
| 3,259,067 | 7/1966 | Bryan | 157/211.5 |
| 3,385,216 | 5/1968 | Henderson | 417/38 X |

*Primary Examiner*—Alan Cohan
*Attorney, Agent, or Firm*—Andrus, Sceales, Starke & Sawall

[57] ABSTRACT

An air charging device is connected to a supply tank, a pump and a use facility, such as a faucet. When the faucet is opened, water flow from the tank through the device to the faucet charges a chamber in the device with air; while when the pump is actuated, water flow from the pump through the device to the tank causes the air in the chamber to be compressed and escape into the tank. The flow of water in either of two directions causes a freely movable valve member to engage and shift a plunger. Movement of the plunger in one direction causes intake of air into the chamber, and movement thereof in the other direction causes compression and discharge of air into the supply tank.

4 Claims, 5 Drawing Figures

WATER FLOW ACTUATED AIR CHARGING DEVICE

BACKGROUND AND SUMMARY OF THE INVENTION

This invention relates to a fluid pressure system, and more particularly to a water flow actuated air charging device for automatically supplying air to a pressurized liquid supply tank.

The device is contemplated for connection to the supply tank, a pump and a use facility, such as a faucet. When the faucet is opened, water flow from the tank through the device to the faucet charges a chamber in the device with air; while when the pump is actuated, water flow from the pump through the device to the tank causes the air in the chamber to be compressed and escape into the tank. The flow of water in either of two directions causes a freely movable valve member to engage and shift a plunger. Movement of the plunger in one direction causes intake of air into the chamber, and movement thereof in the other direction causes compression and discharge of air into the supply tank.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
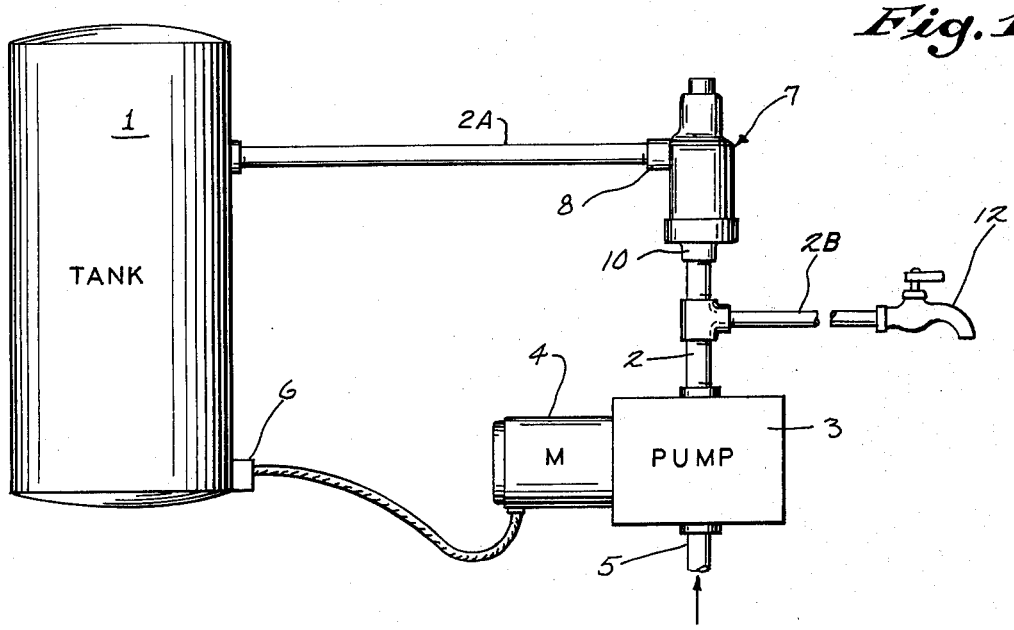
FIG. 1 is a schematic representation of a pumping system employing the air charging device of the present invention.
Figure 4:
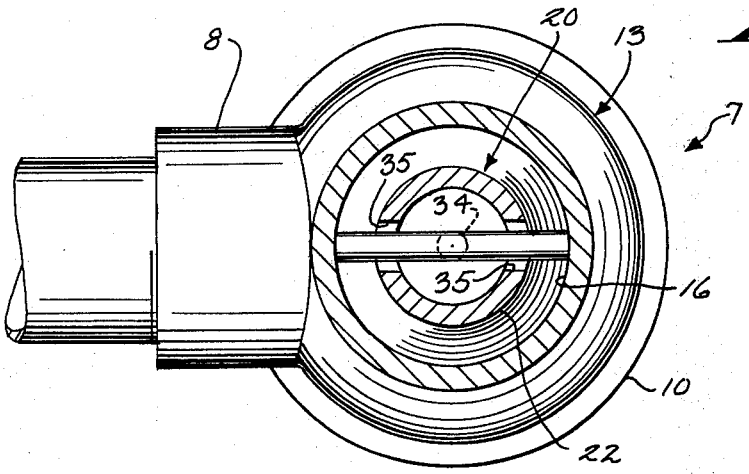
FIG. 4 is a transverse section taken on line 4—4 of FIG. 2.
Figure 5:
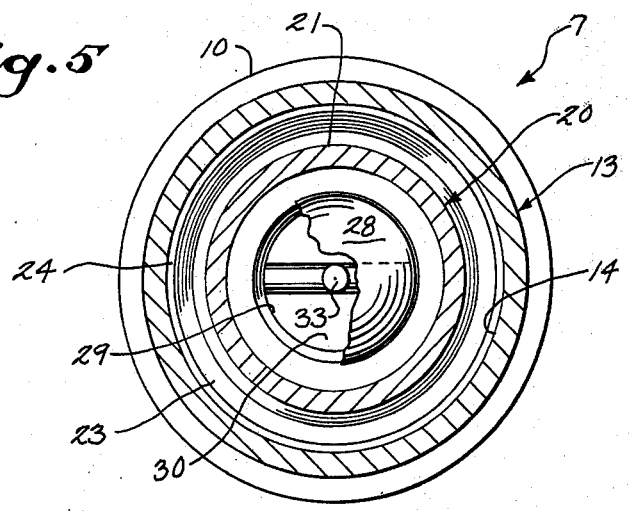
FIG. 5 is a transverse section taken on line 5—5 of FIG. 2.

As shown in the drawings, the device is contemplated for use in a pumping system for supplying a liquid from a well to a liquid storage tank. The pumping system in general comprises a storage tank 1 to store the liquid, such as water, under pressure. The water is supplied to the tank through a conduit or pipe having portions 2 and 2A by a pump 3 which is driven by motor 4. The water is supplied to the pump through a conduit pipe 5, connected to a source of water. The motor is actuated by a switch 6 which is responsive to the pressure in tank 1 and serves to connect the motor 4 to a source of electric current.

As the pressure within the tank 1 falls below a predetermined value, the pressure switch 6 is closed and the motor is actuated to start pump 3 and build up the pressure in the tank to an upper predetermined limit. When the pressure reaches the upper limit, the switch 6 automatically opens and the motor is stopped. The water level within the tank 1 fluctuates between an upper and lower level which corresponds to the upper and lower pressure limits. The upper liquid level in the tank is selected so as to provide a large air cushion or space above the liquid while at the same time provides a comparatively large amount of liquid storage in the tank.

The air charging device 7 of the invention is connected to tank via conduit 2A, as by a fitting 8 providing a fluid flow passage 9 therebetween. Device 7 is also connected to conduit 2, as by a fitting 10 providing a fluid flow passage 11 therebetween.

Conduit 2 is provided with a branch or extension 2B leading to a use facility, such as a faucet valve 12.

More specifically, device 7 comprises an elongated housing 13 having an inner cylindrical wall 14 of enlarged diameter and forming an inner chamber 15; and which connects to an outer cylindrical wall 16 of reduced diameter and forming an outer generally enclosed chamber 17. Fitting 10 closes the inner end portion of wall 14 and chamber 15, while fitting 8 is disposed on the outer side portion of wall 14 intermediate the ends of the housing and inwardly of chamber 17.

Housing 13 encloses means to provide a charge of air in outer chamber 17 automatically upon opening of faucet 12, and means to compress the air in the chamber and permit discharge thereof through passage 9 and conduit 2A into tank 1 automatically upon actuation of pump 3. These means are responsive to water flow through the device between passages 9 and 11. For this purpose, a one way inlet valve 18 is mounted in the closed outer end cap portion 19 of wall 16 and chamber 17. In addition, a cylindrical plunger 20 is disposed within housing 13 and extends between inner and outer chambers 15 and 17. Plunger 20 is constructed for fluid flow through its interior and is adapted for reciprocating longitudinal sliding within the housing. As shown, the plunger comprises an enlarged inner wall portion 21, and an outer wall portion 22 of reduced diameter.

Sealing means are provided between inner plunger wall 21 and inner housing wall 14, as well as between outer plunger wall 22 and outer housing wall 16. For this purpose, and referring to the inner seal, an annular cup-shaped seal 23 of flexible resilient material is secured to the inner end portion of wall 21 and is provided with a longitudinally outwardly facing tapered rim 24 which sealingly engages wall 14. As to the outer seal, an annular cup-shaped seal 25, similar to seal 23, is secured to a closure 26 on the outer end of wall 22 and is provided with a longitudinally inwardly facing tapered rim 27 which sealingly engages wall 16. The seals 23 and 25 are uni-directional and are such that pressure fluid disposed therebetween cannot pass therethrough while pressure fluid external of the plunger ends can, in at least some instances, pass through the seals. Additionally, the seals are constructed so that plunger 20 can move longitudinally without losing the sealing function.

Fluid flow responsive means are provided to shift plunger 20 either in an inwardly or outwardly direction. For this purpose, a lightweight valve member such as a ball 28 is confined in the inner enlarged end portion of plunger 20. Ball 28 is freely movable within the plunger, but is limited in longitudinal movement by an annular inner seat 29 at the inner end of the plunger and which forms a central fluid flow passage 30, and by an annular outer seat 31 which is spaced from and faces seat 29 and which is formed by the juncture of plunger walls 21 and 22 to form a central fluid flow passage 32.

In addition, stop means are provided to limit the longitudinal movement of ball 28 relative to housing 13. For this purpose, an inner stop member 33 is mounted to fitting 10 and projects longitudinally into the inner end portion of chamber 15, while an outer stop member 34 is mounted to housing 13 and projects longitudinally into the outer end portion of chamber 15. Stop members 33 and 34 thus face each other and provide the maximum travel limit to ball 28.

OPERATION

Figure 2:
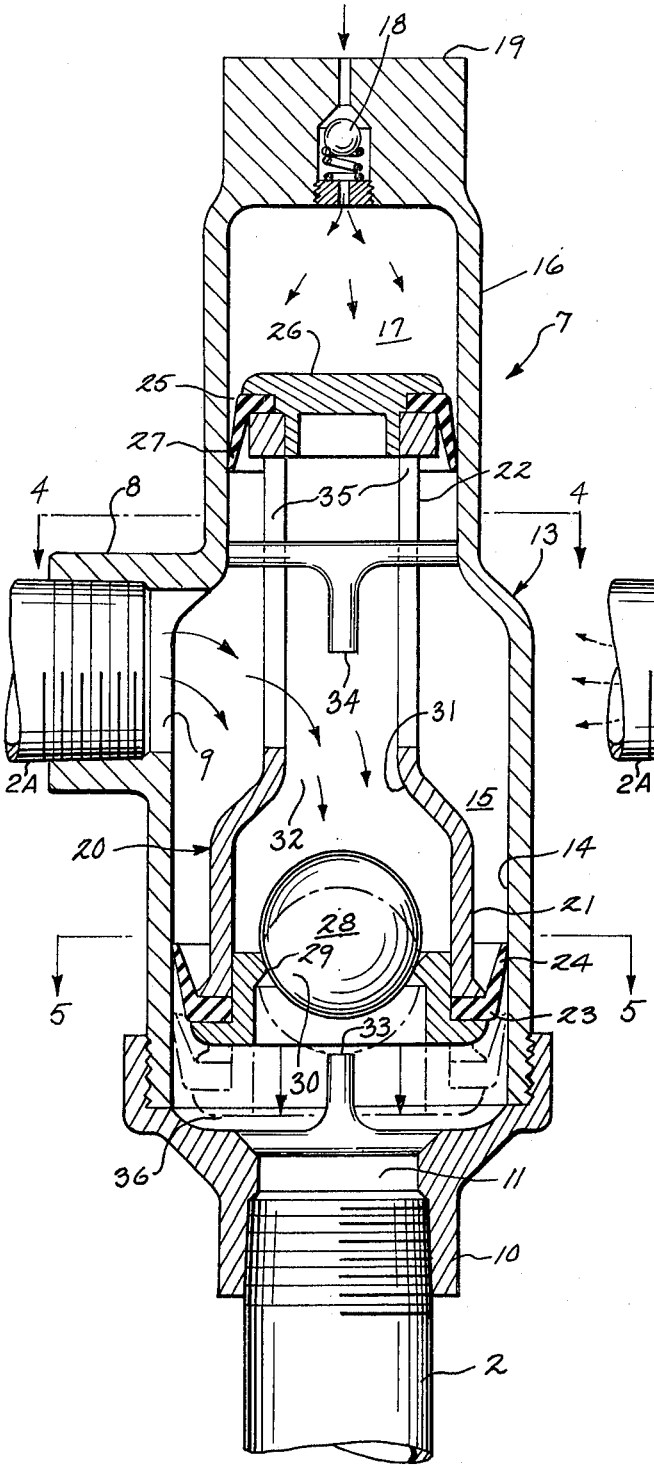
FIG. 2 is a central longitudinal section of the device showing actuation of the plunger to charge the internal chamber.

Referring to FIGS. 1 and 2, when faucet 12 is opened, pressurized water will flow from tank 1 through conduit 2A and passage 9 and into the interior of plunger 20 through longitudinal slot-like openings 35 in wall 22 and hence inwardly, impinging on ball 28. This will cause the latter to move into driving engagement with seat 29, to thereby force plunger 20 inwardly. During this plunger movement, chamber 17 will be expanded, causing air to enter the chamber through one-way valve 18, due to suction. Continued inward ball-and-plunger movement will eventually cause ball 28 to engage stop 33, but plunger 20 will continue moving a short distance permitted by a space 36 and due to the force of the water on the plunger, until the plunger position is equalized with the pressure. Water will thus be able to by-pass ball 28, which is now unseated, and continue on through passage 30 and conduit 2B to faucet 12.

The device of the invention is now charged with air.

Figure 3:
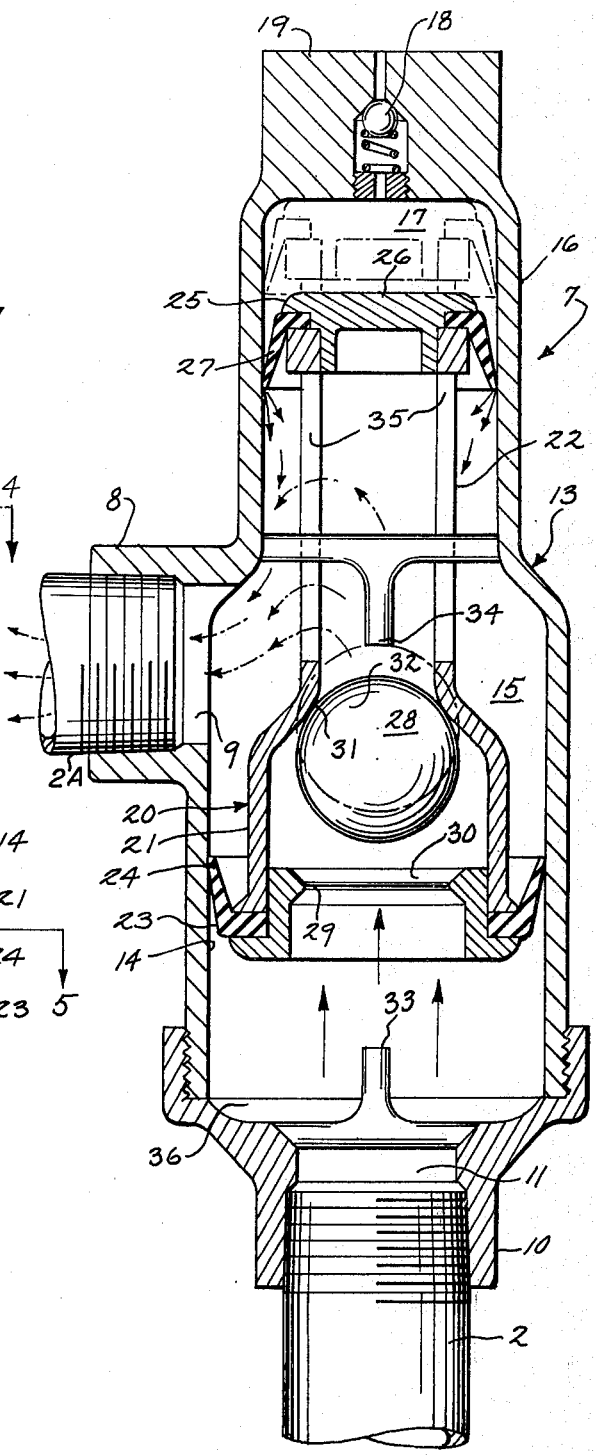
FIG. 3 is a view similar to FIG. 2 and showing actuation of the plunger to compress the air in the chamber and discharge it into the tank.

Referring to FIG. 3, when sufficient water has been used to lower the tank pressure, pump 3 will be activated to force pressurized water through conduit 2 and passage 11 into impingement with ball 28. This will force the latter longitudinally outwardly and into driving engagement with seat 31, to thereby force plunger 20 outwardly. Ball movement will cease when it engages and is unseated by stop 34. At this time, plunger 20 will continue moving until the pressure is equalized and water will then be free to flow through fluid flow passage 32 and through slots 35 and passage 9 as well as conduit 2A and into the tank. During outward piston movement, closure 26 will move outwardly in chamber 17, thereby compressing the air therein. The higher air pressure will cause it to escape inwardly around and by-pass seal rim 27 into chamber 15 so that it mingles with the water entering tank 1 from passage 9 and conduit 2A.

Since the inner end portion of plunger 20 is larger than the outer end portion, a mechanical advantage will be obtained so that the air pressure in chamber 17 will exceed the internal tank pressure, thus assuring air flow past seal rim 27.

Various modes of carrying out the invention are contemplated as being within the scope of the following claims particularly pointing out and distinctly claiming the subject matter which is regarded as the invention.

We claim:

1. In a fluid pressure system, the combination comprising:

a. a tank for storing liquid under pressure, b. a pump for supplying liquid to said tank, c. a first liquid conduit connected to said pump and with said conduit having a use facility valve connected thereto, d. a second liquid conduit connected to said tank, e. and automatic air charging means connected between said first and second conduits, said air charging means comprising:

1. an elongated housing providing inner and outer chambers and with said inner chamber being connected through said first conduit to said tank,
2. a one way air valve connected to the outer end portion of said outer chamber,
3. a plunger disposed for longitudinal sliding movement in said housing and extending between said chambers, the interior of said plunger providing a connection for liquid flow through said second conduit,
4. longitudinally spaced inner and outer valve seat means disposed within the inner end portion of said plunger,
5. and a longitudinally movable valve member disposed in said inner end portion of said plunger and confined between said seat means and freely movable therebetween,
6. said valve member being movably responsive to liquid flow from said tank into said plunger toward said use facility valve when the latter is opened to thereby engage said inner seat means and move said plunger longitudinally inwardly so that air will be drawn into said outer chamber through said one way valve,
7. said valve member also being movably responsive to liquid flow from said pump into said plunger toward said tank when the pump is actuated to thereby engage said outer seat means and move said plunger longitudinally outwardly so that air in said outer chamber will be compressed and discharged into the liquid flowing into said tank through said second conduit.

2. In the system of claim 1:

a. sealing means disposed between the outer end portion of said plunger and the wall of said outer chamber, b. said sealing means being constructed to permit bypassing of compressed air therearound from said outer chamber into said inner chamber upon outward longitudinal plunger movement.

3. In the system of claim 1, longitudinally spaced stop means disposed in said inner chamber and with said stop means being engageable by said valve member during plunger movement to unseat said valve member from the respective inner or outer seat.

4. The system of claim 1 which includes; opening means disposed in the wall of the outer end portion of said plunger for providing the liquid flow connection between said first and second conduits.

* * * * *